US006511751B2

(12) United States Patent
Höller et al.

(10) Patent No.: US 6,511,751 B2
(45) Date of Patent: Jan. 28, 2003

(54) STOPPER ROD

(75) Inventors: Wolfram Höller, Leoben (AT); Dirk Masurat, Wiesbaden (DE)

(73) Assignee: Veitsch-Radex GmbH, Vienna (AT)

( * ) Notice: Subject to any disclaimer, the term of this patent is extended or adjusted under 35 U.S.C. 154(b) by 8 days.

(21) Appl. No.: 09/734,422

(22) Filed: Dec. 11, 2000

(65) Prior Publication Data

US 2002/0031668 A1 Mar. 14, 2002

(30) Foreign Application Priority Data

Dec. 24, 1999 (DE) ..... 199 63 147

(51) Int. Cl.[7] ..... B32B 9/00

(52) U.S. Cl. ..... 428/408; 222/501; 222/566; 222/602; 222/603

(58) Field of Search ..... 428/408; 222/602, 222/566, 501, 603; 266/272, 271

(56) References Cited

U.S. PATENT DOCUMENTS 3,801,083 A * 4/1974 Mantey et al. ..... 266/38

4,791,978 A * 12/1988 Fishier ..... 164/437

FOREIGN PATENT DOCUMENTS

| | | |
|---|---|---|
| EP | 0320481 A1 | 11/1988 |
| EP | 0721388 B1 | 8/1998 |

* cited by examiner

*Primary Examiner*—Deborah Jones
*Assistant Examiner*—Abraham Bahta
(74) *Attorney, Agent, or Firm*—Craig C. Cochenour; Buchanan Ingersoll, P.C.

(57) ABSTRACT

The invention concerns a stopper rod with a cylindrical stopper rod body comprising a fire-resistant, carbon-containing material, having a base part and a nose-like section made of a different fire-resistant material than the base part, whereby an interface extends between the nose-like section and the base part over the entire cross-section of the stopper rod body, wherein the nose-like section comprises a fire-resistant material wherein the carbon content burns out under oxidic atmosphere above 90° C., at least close to a surface area.

6 Claims, 1 Drawing Sheet

STOPPER ROD

The invention concerns a monobloc stopper rod to control the outflow of metallurgical melt containers.

Such a stopper rod e.g. disclosed in EP 0 721 388 B1 consists of a cylindrical stopper rod body made of a fire-resistant, carbon-containing material. The stopper rod body has a section in a base part to receive a guide rod, and it has a cap-like section at its end.

With the aid of the cited guide rod, the monobloc stopper is guided away in an axial direction from an associated outlet in the metallurgical container when the metal melt is to flow out, or lowered to the outlet to seal it if the flow of molten metal is to be reduced or interrupted.

It is known that chemical reactions can cause encrustation which clog the outlet and make it difficult or impossible to control the melt flow.

To prevent this problem, EP 0 721 388 B1 suggests a generic stopper plug where the stopper plug body is completely or partially covered with a layer consisting of 4–9 weight percent carbon and at least one sintering promoter. The surface layer compresses after being heated above 1,000° C. and becomes impervious to gas. The stated thickness of the layer is less than 10 mm. According to an exemplary embodiment, the layer is limited to the nose-like section of the stopper rod.

Such a stopper rod is difficult to manufacture, especially when it is to be isostatically pressed as suggested in EP 721 388 B1; the cited surface layer on the nose-like section is difficult to produce in a corresponding press mold. In addition, the layer can easily fracture when it is used.

The problem of the invention is therefore to improve a stopper plug of the cited type so that it can be manufactured in a simple process, reliably prevents the cited encrustation, and allows flawless use as a control organ in metallurgical melt containers.

DETAILED DESCRIPTION OF THE INVENTION

Figure 1:
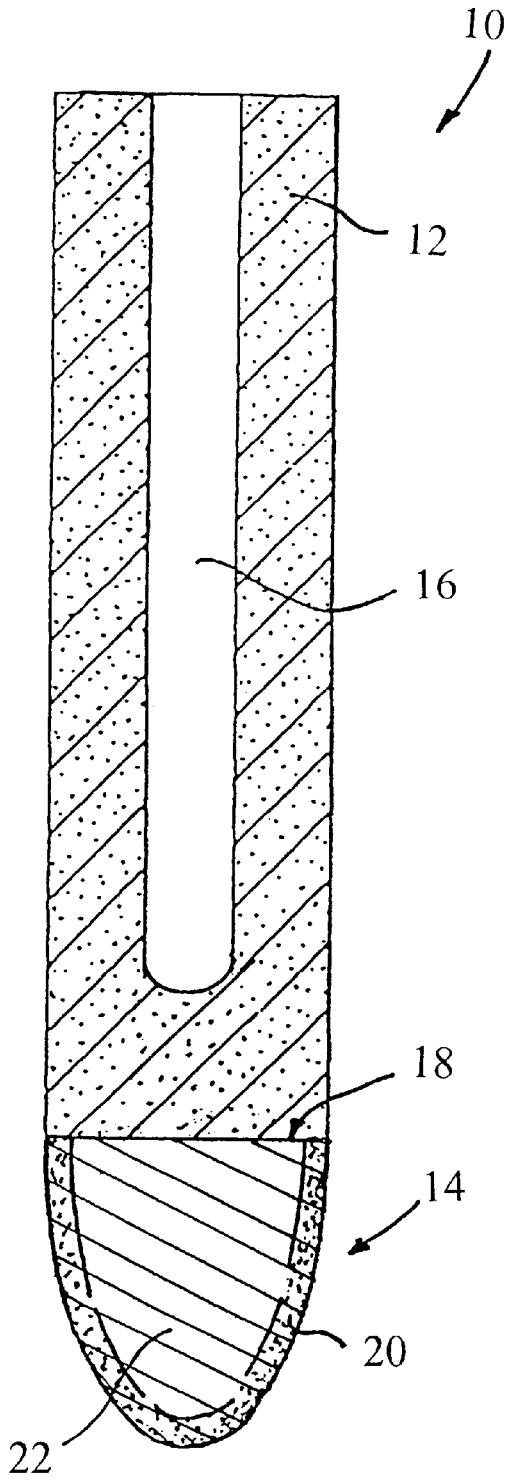
FIG. 1 shows a schematically portrayed lengthwise section of the stopper rod according to this invention.

The basic concept of the invention is to make the entire nose-like section out of a different refractory material than the base part instead of just the surface protective layer on the nose-like section. An interface is formed between the nose-like section and the base part over the entire cross-section of the stopper rod.

The stopper rod is hence easy to manufacture, e.g. by pressing. First the material of the nose-like section is filled into the mold, and then the mold is filled with the material of the base part before pressing begins. During pressing, the materials of the base part and nose-like section are bonded over the entire cross-section of the stopper rod.

Another essential feature of the invention is that the nose-like section consists of a fire-resistant material whose carbon portion burns out when treated under oxidizing atmosphere above 900° C., at least in a surface area. In other words, although the entire nose-like section consists of the same carbon-containing material, different zones are formed in the nose-like section after firing, that is, an inner part that still contains carbon, and an outer part that is free of carbon that covers the entire nose-like section.

Since the nose-shaped section and base section are adjacent over the entire cross sectional area of the stopper rod body, there is no risk of the carbon-free surface layer of the nose-like part breaking off.

The stopper rod can be further optimized by leaving the nose-like section unglazed to support the burning of the carbon in the surface area.

In contrast, the surface of the base part can be glazed to give it greater strength and chemical resistance.

The nose-like section can consist of a material with a carbon content of <10 percent by weight. Thermal expansion is low if the material for the nose-like section is based on zirconium mullite. The content of zirconium mullite is over 50 percent by weight. Other fire-resistant oxides and/or sintering promoters can be added to the material mixture. The material for the nose-like section can contain 5–20 percent by weight silicon nitride.

As stated, the base part consists of a different refractory material such as a material with a carbon content >20 percent by weight up to 35 percent by weight. The base material would then for example consist of aluminum oxide and/or corundum, i.e., alumina-containing components to which sintering promoters can be added at portions normally under 8 percent by weight.

The above figures refer to unfired stopper rods. According to one embodiment, the stopper rods are designed so that they have a carbon-free surface layer in the nose-like section that is at least 4 mm thick after being oxidized above 900° C. The thickness of this layer is typically 4–10 mm when the cylindrical stopper rod body diameter is at least 300 mm, but the diameter may be larger.

Other features of the invention can be found in the subclaims and other application documents.

The invention will be further explained in the following with reference to an exemplary embodiment. The figure shows a schematically portrayed lengthwise section of a stopper rod according to the invention.

Reference number 10 refers to the entire stopper rod that consists of a base part 12 and a nose-like (caplike) free end section 14.

From the top end of the base part 12, an axial cavity 16 runs in the middle that serves to receive a metallic guide rod (not shown).

The materials of the base part 12 are 95 percent by weight corundum and graphite with the remainder a sintering promoter.

Reference number 18 identifies a circular interface between the base part 12 and the nose-like section 14.

The nose-like section 14 comprises a material based on zirconium mullite, and it contains 15 percent by weight silicon nitride, 5 percent graphite, and 5 percent by weight sintering promoter.

The portrayed stopper rod is oxidized (fired under oxidic conditions) at approximately 1,000° C. leading to an approximately 5-mm-thick surface area of the noselike section 14 (identified with reference number 20) being free of carbon, while the enclosed core 22 of the nose-like section 14 still contains carbon.

The integral design of the nose-like section 14 along an interface 18 to the base part 12 produces an intimate bond of the sections 12, 14 pressed together; after being fired, an integral carbon-free surface layer 20 is formed on the nose-like section 14.

We claim:

1. A stopper rod comprising 1.1 a cylindrical stopper rod body (10) that comprises a base part (12) to receive a guide rod and a nose-like section (14) at its free end, wherein 1.2 an interface (18) extends between the nose-like section (14) and the base part (12) over the entire cross-section of the stopper rod body (10), and 1.3 the nose-like section (14) comprises a fire-resistant material with a carbon content less than ten percent by weight which carbon burns out under oxidic atmosphere above 900° C., at least close to a surface area of said nose-like section wherein different zones are formed in said nose-like section after firing, said nose comprising an inner part containing carbon and an outer part that is carbon free, and 1.4 the base part (12) comprises a different fire-resistant material with a carbon content greater than twenty percent by weight.

2. The stopper rod according to claim 1 wherein the nose-like section (14) is not glazed.

3. The stopper rod according to claim 1 wherein the base part (12) surface is glazed on its surface.

4. The stopper rod according to claim 1 wherein the nose-like section (14) comprises a material based on zirconium mullite.

5. The stopper rod according to claim 1 wherein the base part (12) comprises a material based on aluminum oxide, corundum or both.

6. The stopper rod according to claim 1 with a surface layer (20) of the nose-like section (14) that is at least 4 mm thick and free of carbon, after being fired above 900° C. under oxidic conditions.

* * * * *